United States Patent [19]

Frazier et al.

[11] Patent Number: 4,501,325

[45] Date of Patent: Feb. 26, 1985

[54] METHOD FOR PREDICTING WORKOVERS AND SHUT-INS FROM ANALYZING THE ANNULUS EFFLUENT OF A WELL

[75] Inventors: Terry L. Frazier, Paso Robles, Calif.; Henry J. Grimm, Allentown, Pa.; John F. Rooney, Houston, Tex.; Richard S. Allen, Houston, Tex.; Alfred Brown, Houston, Tex.; Donald S. Mims, Houston, Tex.

[73] Assignee: Texaco Inc., White Plains, N.Y.

[21] Appl. No.: 539,602

[22] Filed: Oct. 6, 1983

Related U.S. Application Data

[63] Continuation-in-part of Ser. No. 305,439, Sep. 25, 1981.

[51] Int. Cl.[3] ..... E21B 43/16

[52] U.S. Cl. ..... 166/250; 166/252; 166/265; 73/155

[58] Field of Search ..... 166/250, 252, 264–266; 73/155

[56] References Cited

U.S. PATENT DOCUMENTS

| | | | |
|---|---|---|---|
| 2,916,916 | 12/1959 | Holsclaw | 166/252 |
| 3,371,527 | 3/1968 | Moulin | 166/250 X |
| 4,127,170 | 11/1978 | Redford | 166/252 |
| 4,224,988 | 9/1980 | Gibson et al. | 166/250 |

*Primary Examiner*—Stephen J. Novosad
*Assistant Examiner*—Thuy M. Bui
*Attorney, Agent, or Firm*—Jack H. Park; Kenneth R. Priem; Harold J. Delhommer

[57] ABSTRACT

The disclosed invention is a method for analyzing the annulus effluent of a producing well in a steam flood and using the information derived therefrom to determine whether to workover the production well for greater production, whether to allow the well to continue producing "as is", or whether to shut-in the annulus or the tubing production and approximately when the well should be worked over or shut-in.

14 Claims, 3 Drawing Figures

METHOD FOR PREDICTING WORKOVERS AND SHUT-INS FROM ANALYZING THE ANNULUS EFFLUENT OF A WELL

BACKGROUND OF THE INVENTION

This application is a continuation-in-part of U.S. patent application Ser. No. 305,439, filed Sept. 25, 1981. This application is also related to U.S. patent application Ser. Nos. 305,561 and 305,574, both filed on Sept. 25, 1981 now abandoned, the specifications of which are herein incorporated by reference.

This invention relates to a method of gathering production data and using that data to determine when to shut in or workover a producing well in a steam flood operation.

Secondary recovery is the recovery by any method of oil which enters a well as a result of fluid injected after a reservoir has approached its economic production limit by primary recovery methods. Steam flooding has been found to be a successful method of secondary hydrocarbon recovery.

After a steam flood has matured, production may decline for several reasons. A common problem is the creation of a steam override zone through which the steam flood continues to sweep, bypassing much higher oil saturations. This problem can often be partially solved by a workover and recompletion of the production well in a lower portion of the formation. Mechanical problems can also occur with the well which substantially restrict production. These problems can often be solved by workovers. Furthermore, a large percentage of the injected heat (frequently 25% to 50%) may escape the formation through the casing annulus along with light hydrocarbon condensate and noncondensable gases. It may be desirable to shut off a portion of the well's producing zone or even shut-in the entire production from the well for the benefit of the overall steam flood.

Workovers, however, can be very expensive and frequently take a well out of production for a period of time. Thus, it is important and profitable to know whether a particular workover should be performed as well as when to execute the workover.

Economic consideration of a workover must take into account the profit to be made out of oil or gas production. Payout of a specific job depends on the cost of the work, the potential revenues to be obtained, the reserves in the field and the producing rate after the workover. Planning for a workover must take into consideration the original completion, the type of production, and the mechanical problems involved. Detailed information about the well is needed to make these decisions. In steam flood operations, however, accurate production information is difficult to obtain because of variable temperatures, emulsions, flow regimes involved and the high produced heat load.

Oil obtained by workovers is often the lowest cost production that can be obtained by an oil company because the finding cost is zero, and because a sizeable part of the well cost has already been spent before the workover is started. With sufficient information for proper planning, production obtained from old wells after a workover is often the most economical oil obtainable. Accordingly, it is of great importance to know exactly when a producing well should have a workover for increased production.

U.S. Pat. No. 2,916,916 discloses a well apparatus mounted on a trailer for measuring the water/oil ratio of produced fluids. The apparatus consists of a settling tank on wheels having a transparent window for viewing the location of the water/oil interface if and when the respective fractions separate. U.S. Pat. No. 3,371,527 describes a wellbore tool for measuring water cut as well as the density and rate of flow of produced fluids. A method for automatically determining the long-term average of several properties (fluid flow rate, water cut) of producing wells by computer analysis is disclosed in U.S. Pat. No. 3,525,258.

SUMMARY OF THE INVENTION

The present invention comprises a method for analyzing the annulus effluent of a producing well in a steam flood and using the information derived therefrom for a variety of purposes. The information can be used to determine whether to workover the production well for greater production, whether to allow the well to continue producing "as is", or whether to shut-in the annulus or the tubing production and approximately when the well should be worked over or shut-in. This information when combined with similar information from nearby wells can also be used to determine the approximate vertical and areal conformance of the steam flood through the reservoir and to estimate annulus production and the needed size of an annulus gathering system.

The method is preferably performed by continuously sampling the annulus effluent and identifying the basic components (water, noncondensable gases and light hydrocarbon condensate) of the effluent production, measuring the rate of production and calculating the estimated volume of oil contacted by the produced steam in the formation from the above information and from previous correlations drawn between steam and the light hydrocarbon condensate produced after contacting similar volumes of oil with steam. The method is particularly advantageous when performed with a movable apparatus in the field.

DETAILED DESCRIPTION

Figure 1:
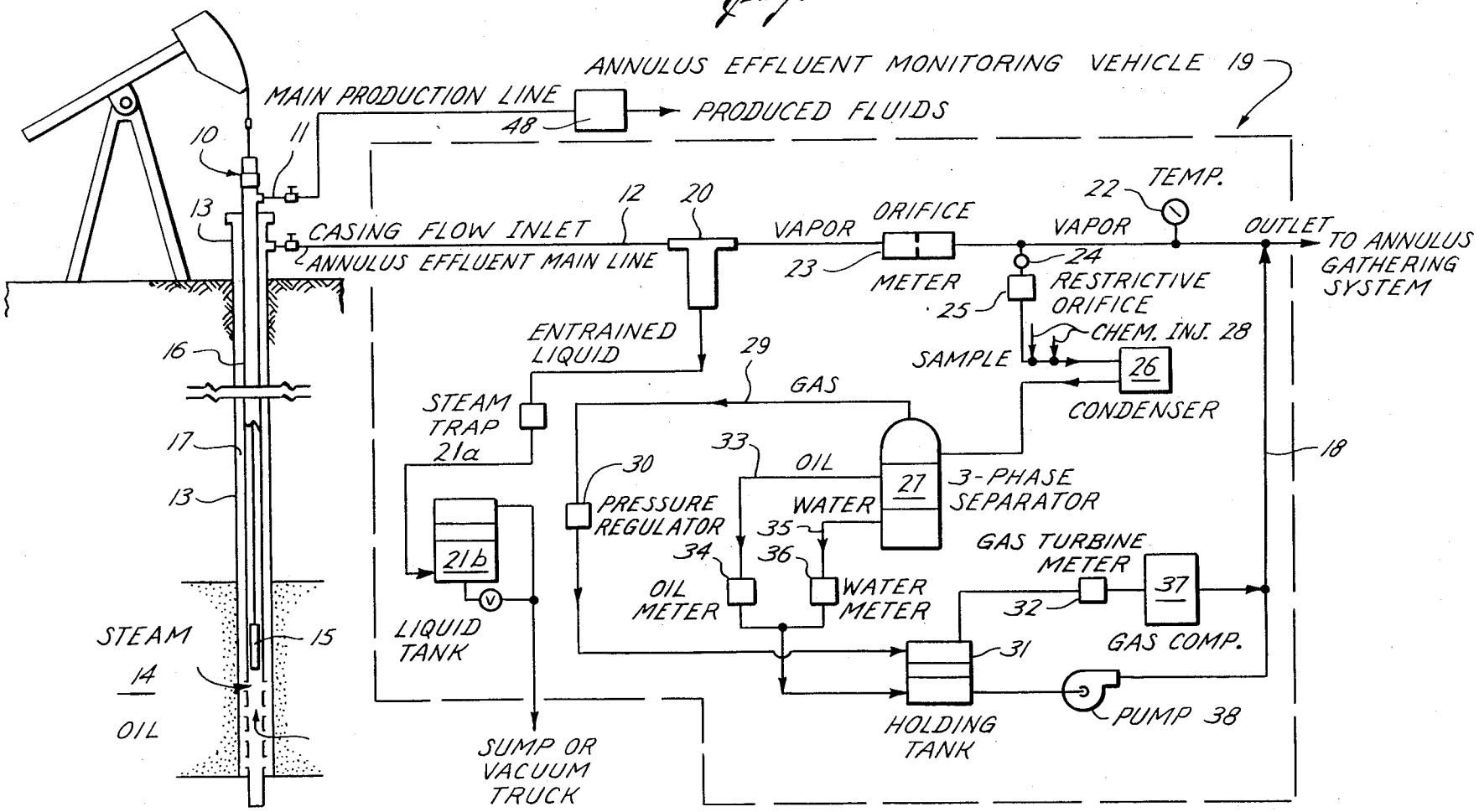
FIG. 1 is a schematic flow chart of an apparatus for carrying out the method of the invention.

The careful monitoring of the producing wells in a steam flood gives valuable information which permits decisions to be made on whether a well should be worked over for greater future production, allowed to continue producing "as is", or shut-in for the benefit of the rest of the steam flood. The present invention is a method which employs the information gathered from monitoring of the annulus effluent and further uses that information to determine the best disposition for the well.

Although information about the annulus effluent of producing wells is frequently available, such availability is almost always limited to information relating to cumulative annulus effluent production for a large group of wells. The economic nature of large steam flood operations prevents equipment from being installed at each well to gather information all on the annulus effluent or on the tubing production. Normally, tubing oil production will not even be known for individual wells. Instead the tubing oil production and annulus effluent production for different components will only be known for large groups of wells. The present invention is a method of gathering information about individual wells and using that information to determine the best disposition for those individual wells.

The method of the invention comprises steps of (1) measuring the flow rate of the annulus effluent, which will also require measuring the temperature and pressure of the annulus effluent;
(2) condensing the annulus effluent;
(3) separating the condensed annulus effluent into the three phases of light hydrocarbon condensate, water (which includes produced steam and liquid water) and noncondensable gases;
(4) measuring the quantities of each of the three phases of the annulus effluent;
(5) calculating a ratio of the quantity of light hydrocarbon condensate to the quantity of water in the annulus effluent;
(6) calculating the minimum economic oil production from the well cost and estimated production revenues;
(7) calculating the estimated volume of oil contacted by the steam in the formation from previous correlations drawn between steam and light hydrocarbon condensate produced as vapor after contacting predetermined volumes of oil having the same characteristics as the oil from the producing well; and finally
(8) determining the best disposition of the well using several guidelines based upon the ratio of light hydrocarbon condensate to water produced in the annulus effluent.

It has been surprisingly discovered that the ratio of light hydrocarbon condensate to water produced in the annulus effluent provides a strong indication of the actual tubing production of the well, the potential tubing production of the well, the existence of mechanical difficulties with the well and when a well should be worked over. We have discovered that for California crude having an API gravity of about 12°–13° and taking into account the cost of production and revenue obtainable in 1983, that if the ratio of light hydrocarbon condensate to water is greater than about 0.08, the well should, in most cases, be left to produce "as is". However, even with such a relatively high hydrocarbon condensate to water ratio, it may be advisable to check the well for mechanical production problems by measuring tubing oil production. It is possible for well production to be substantially below minimum economic oil production even though the condensate to water ratio of the annulus effluent is greater than 0.08.

If the ratio is less than about 0.08 and upon measurement, the actual tubing and annulus production is greater than the minimum economic oil production, the well should, of course, be left to produce "as is". If the (a) ratio of condensate to water is less than about 0.08 and (b) the estimated volume of oil contacted by the steam is less than the minimum economic oil production and (c) actual tubing and annulus production is less than the minimum economic oil production, the well's tubing and annulus production should be shut-in. Finally, if (a) the ratio of condensate to water is less than about 0.08 and (b) the estimated volume of oil contacted by steam is greater than the minimum economic oil production and (c) actual tubing and annulus production is less than the minimum economic oil production, a workover should be performed on the well.

The value of the condensate to water ratio of 0.08 mentioned above provides a guideline well suited for the heavy California crude produced from a central California field considering production cost and revenues to be obtained. The ratio guideline should be recalculated for different steam flood conditions and different crude oils. However, the guideline of 0.08 provides a good base from which to work. For example, if the cost of steam generation for the steam flood is substantially greater than the costs which have been incurred in the above-mentioned California field, then the condensate to water ratio of 0.08 may be indicative of the need for a workover or shutting-in of the well rather than profitable production. With higher costs, the ratio guideline should be higher. Factors which effect this ratio include the price the condensate is sold for compared to the cost of the lost steam and heat, the price received from the tubing oil production, production and drilling costs for the steam flood and the relationship between condensate annulus production and tubing oil production, which can vary with the gravity and with the composition of the oil.

In a preferred embodiment of the method, representative samples are taken of the annulus effluent and analyzed rather than continuously analyzing the entire flow of the annulus effluent. Further, it is preferred to split the effluent samples into vapor and entrained liquid streams for greater accuracy. The entrained liquid stream is then further separated into oil and water phases and the quantities of each phase are measured.

The vapor stream is handled as mentioned before, by condensing the vapor stream, separating it into its three phases, measuring the quantities of those phases, and so forth. But, the amount of entrained liquid water must be added to the amount of water phase in the vapor stream to obtain the total water in the annulus effluent for the purpose of calculating the ratio of light hydrocarbon condensate to water.

Part of the method involves the calculation of the estimated volume of oil contacted by the steam in the formation. This is based upon the amount of light hydrocarbon condensate produced as a vapor with steam in the annulus effluent. It was unexpectedly discovered that the amount of light hydrocarbon condensate produced as a vapor with the steam is dependent upon the volume of oil contacted by the steam in the formation. This relationship, of course, changes with the composition and gravity of the crude contacted. Our studies have shown a close relationship between the amount of oil contacted by the steam in laboratory studies and the volume of oil contacted in the formation.

Figure 2:
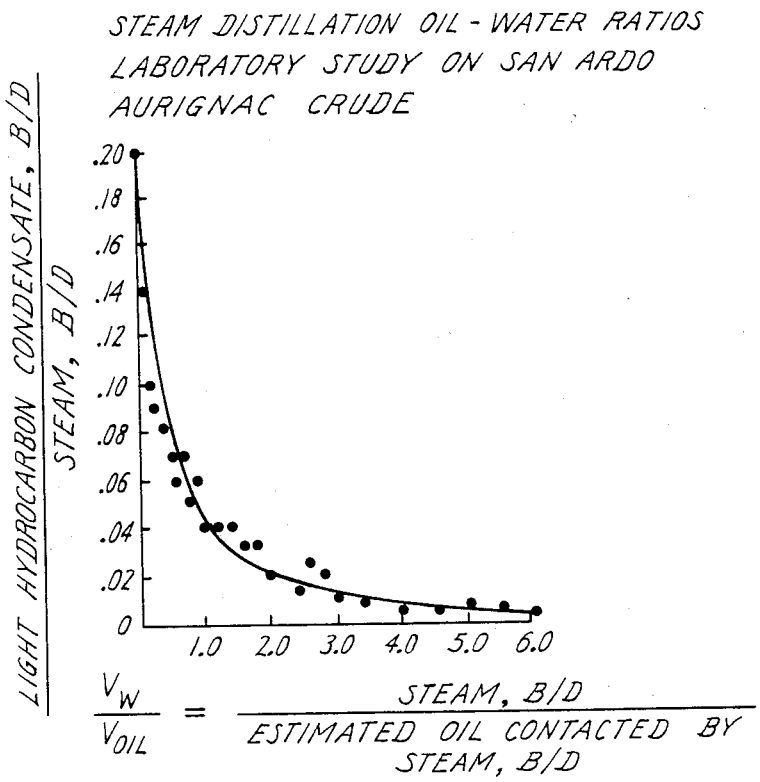
FIG. 2 is a steam distillation curve prepared from laboratory data for a particular crude oil.

Thus, laboratory tests must be performed on formation oil to obtain the correlation between the amount of condensate produced in the annulus effluent along with the volume of steam produced as it relates to the amount of oil contacted in the formation. This correlation is shown in the graph of FIG. 2, a laboratory study on the oil-water ratios of a particular formation crude.

A 91 centimeter cell containing oil in the bottom of the cell was used in laboratory tests. Steam was bubbled through the oil from the bottom. The height of the oil in the cell was calculated to be the minimum height that would not cause liquid entrainment and would produce only vapors off the top of the cell. It is believed that this mechanism roughly approximates the production of light hydrocarbon condensate as a vapor along with steam in the annulus effluent. The steam contacts and strips the condensate from the oil in both the wellbore and the formation. New correlations must be measured and calculated for different crude oils.

The method of the invention can be further expanded to include several optional steps. Under certain conditions, it may be necessary or helpful to add a demulsifying agent to the vapor stream or the annulus effluent stream to aid in separating the stream into the three phases of the light hydrocarbon condensate, noncondensable gases and water.

Furthermore, considerable information can be gained by measuring the API gravity of the light hydrocarbon condensate as well as the API gravity of the entrained liquid oil. For example, an increase in the API gravity of the hydrocarbon condensate would indicate that the steam was contacting new oil in the formation. A relatively lower API gravity of the condensate would indicate that the steam was primarily contacting a depleted zone in the formation.

The method of the present invention of evaluating the annulus effluent of a producing well and steam flood is useful for many different purposes. By identifying the components of the annulus effluent and the relative quantity of each of those components, and obtaining the steam quality and the mass flow rates of the annulus effluent, wells which should be shut in and wells which should be worked over can be identified. Additionally, by periodically monitoring wells which are potential candidates for shut-in or workover, the most economical time for performing a shut-in or a workover can be predicted by measuring little more than the easily measured ratio of light hydrocarbon condensate to steam produced. The use of a mobile apparatus for carrying out the invention method in the field permits such periodic monitoring to be easily accomplished.

After sufficient information has been gathered on the annulus effluent production of a field-wide steam flood or on particular wells, it is rarely necessary to go through the time consuming technique of measuring tubing production for an individual well. The annulus effluent monitoring apparatus (AEM) can be easily connected to a well to record data and perform calculations within a matter of hours, whereas it may take one or more days to obtain accurate information on tubing production. After sufficient information has been gathered, it will be known that a specific ratio of condensate to water will be associated with a specific volume of tubing production. A series of computer programs have been developed to calculate (by methods well known in those skilled in the art) flow rates, composition and heat content of a well's casing effluent based on data obtained with the method.

The method may also be used to evaluate the heat production in a well. Since the method identifies the components of the annulus effluents and their relative amounts, it is only necessary to multiply the amounts of each component by the heat content of each component at the particular temperature. A summation will then give total heat content of the annulus effluent from each wellhead. The heat content of the tubing production (oil and water) may also be substantially greater than the heat content of the annulus effluent, particularly if the tubing production is relatively high. The tubing production heat content can be easily calculated by determining the heat enthalpy of the oil and water at the production temperature and summing the products of the heat enthalpy of the oil and water and the respective flow rates of each. For a strict accounting of heat, it may be necessary to consider heat transfer from the annulus production to the tubing production and the adjacent formation.

For more accurate figures on minimum economic oil production the minimum economic production should be increased by the cost of producing a sufficient amount of steam to equal the overall heat flow rate for each well. In other words, a standard calculation of minimum economic tubing production for the California wells upon which this method was tested was about 20 barrels of oil per day. Ordinarily, one would assume that tubing oil production of 30 barrels of oil per day would be enough to justify continued production from the well. However, if it requires 15 barrels of oil per day to produce the steam equivalent to the heat lost from the well, the well should clearly be considered an uneconomic well as it would have to produce substantially more oil through the tubing to equal the heat loss. The well should preferably be shut-in so that the formation could retain the steam and heat to increase production from other wells. This assumes that annulus heat production cannot be curtailed without substantially decreasing tubing oil production. Consequently, by the use of the present method, a much truer minimum economic production per well can be obtained by figuring in the lost heat production of the annulus effluent.

Customarily, minimum economic oil production is only measured against tubing oil production. But if an annulus effluent gathering system is employed to collect the annulus effluent for use and sale, annulus production per well should be added to the tubing oil production to determine if the well is producing more than the requisite minimum economic oil production.

The success of a workover on a well can also be easily determined. A successful workover should show substantial reductions in annulus flow rates, steam quality, temperature and heat flow rate. A successful workover should also show an increase in tubing oil production rate, an increase in the light hydrocarbon condensate to water ratio of the annulus effluent and light hydrocarbon condensate having a higher API gravity.

Furthermore, the method permits the easy forecasting of condensate production for a large steam flood and the requirements of an annulus gathering system. The capacity of an annulus gathering system can be estimated by summing the information of the annulus effluent for each well. In addition, after collection of considerable data the vertical and areal conformance of the reservoir to the steam flood can be predicted. Such information is extremely valuable for planning the future of the steam flood including a determination of where and how to drill new wells.

Operation procedures in a steam flood can also be monitored and altered as needed. The vast wealth of information that can be obtained from this method of evaluating the annulus effluent of producing wells can be applied to determine when to change the method of steam injection. The timing of conversions of corner and infield wells from producers to injectors can also be enhanced. Foam-air treatments can be monitored and evaluated. The effectiveness of downhole steam generation can also be monitored with this method. The steam entering the formation can be monitored by returning the steam to the surface to the AEM. The output of different steam generators can also be monitored by the use of tracers and the present method. The benefits of insulated tubing can be also be evaluated.

A SUGGESTED APPARATUS FOR PERFORMING THE PREFERRED METHOD

FIG. 1 is a flow diagram illustrating the well bore and a suggested apparatus for carrying out the preferred invention method. Different apparatus are certainly possible as well as a different flow arrangement. This is one suggested flow diagram for the preferred method.

An oil well 10 is illustrated with a main production line 11 for passage of crude oil and an annulus effluent main line 12 for delivering the annulus effluent from the well casing 13 to an annulus gathering system (not shown). Crude oil may be pumped from the formation 14 by a conventional oil pump 15 through the production tubing 16 within the perforated casing 13 into the main production line 11. The steam, light hydrocarbon condensate and gases in the formation generally pass through the perforated casing and up the well annulus 17 formed between casing 13 and production tubing 16 into the main annulus effluent line 12.

While the method of the present invention may be carried out in the field or in a laboratory, it is, of course, preferable to employ the method in the field. Although the apparatus for the method may be attached to each well, the most preferred mode is to mount the necessary apparatus on a movable platform or vehicle. In this way, the necessary apparatus may be moved from one well to another in the same field with ease, saving on apparatus costs. It is also preferred that the apparatus be explosion proof with explosion proof motors, enclosures for certain parts and protected electrical conduits.

The overall sample loop 18 is connected directly to the annulus effluent main line 12 as shown in FIG. 1 or adjacent to the main line 12 to analyze selected samples diverted from the main line 12. A liquid-vapor separator 20, such as a cyclone separator, may be mounted on the annulus effluent main line 12 to separate the entrained liquids from the annulus effluent sample into a liquid dump tank **21*b*, such as an oil and water tank, leaving only vapor in the effluent main line 12. After the entrained liquids (oil and water) are separated from the annulus effluent vapors, they pass through a steam trap 21*a* for ensuring that no vapors escape or pass along with the liquids to an atmospheric pressure collection and oil-water separation tank 21*b*. The tank, which receives the oil and water liquids, separates the water from oil by settlement. The quantities of water and oil are measured and recorded on field data sheets for integration with the rest of the well information. All piping should be well insulated to reduce heat losses and ensure that gaseous vapors do not condense after passing through the liquid-vapor separator 20**. Each well test is begun with an initial start-up period of about thirty minutes so that steady state gaseous flow can be established in the apparatus.

Downstream from the liquid-vapor separator 20 is a temperature gauge 22, for indicating the temperature of the annulus effluent and an orifice plate meter 23, which measures the vapor flow rate. Another orifice 25 downstream of meter 23 maintains a continuous critical restrictive flow of vapors to the vapor portion of the sample loop 18.

The flow rate is measured with orifice meter 23 by measuring the differential in pressure. This can be done by either of two methods, a totalizer measured flow rate or a differential pressure measurement. The first method utilizes a totalizer sold by Daniel Industries which measures the differential pressure (p) across an orifice and corrects the p for the actual static pressure and temperature, based on continuous air flow through the orifice. The true p is used to calculate the amount of vapors that flowed during the test period. A computer program corrects the flow rate for the actual vapor composition flowing through the orifice meter.

In the second method the p and static pressure of the orifice is continuously recorded on a circular type chart. The average p and static pressure are found by integrating the chart recording. A computer program calculates the flow rates in standard conditions giving the average p, static pressure and temperature.

Although the totalizer method is more accurate, the second method offers the advantages of ease of calibration, maintenance, and trouble-free operation. The second method utilizes a standard oil field p cell that can be repaired by field personnel. The totalizer and its pressure transducers are proven field devices, but if they malfunction, they must be sent back to the factory for repairs, increasing downtime.

A sample loop valve 24 directs the vapor flow from the annulus effluent main line 12 to the vapor portion of the loop 18. The vapor then passes through a restrictive orifice 25, which controls the flow rate to a maximum volume or amount, such as about 10–25 liters/hr. liquid equivalent flow rate for a typical small vehicle. This critical orifice 25 which can be changed for varying static pressures provides a vapor sample in a predetermined flow rate range for monitoring noncondensable gases, vaporous light hydrocarbon condensate, and steam condensate.

Downstream of the critical orifice 25, the sample effluent flows past emulsion breaking chemical injection ports 28, which may or may not be needed, and through a condenser 26 for cooling the vapor sample to 10°–20° F. above ambient temperature. A suggested condenser 26 is a vertical air-cooled apparatus. This mixture of noncondensable and condensed vapor then enters a three-phase separator 27.

After separating the condensed vapor into three phases, the three-phase separator 27 dispenses the noncondensable gases out of line 29, through a pressure regulator 30 for maintaining a constant pressure in the line and the separator and through a holding or dump tank 31 to a gas meter 32 for measuring the gas flow. From there, the gas is returned to the annulus effluent main line 12 by gas compressor 37.

The three-phase separator 27 dispenses the oil out of line 33 to oil meter 34 for measuring the amount of oil in the sample before being discharged to the dump tank 31 and back into the annulus effluent main line 12 by pump 38. Likewise, the three-phase separator 27 dispenses the third major phase of the sample annulus effluent, water, out through line 35 to water meter 36 for measuring the amount of water in the sample before discharge to the dump tank 31 and the annulus effluent main line 12 by pump 38. All meters preferably transmit their information to recorders or an electronics housing.

The following examples will further illustrate the novel method of analyzing the annulus effluent of a well. These examples are given by way of illustration and not as limitations on the scope of the invention. Thus, it should be clearly understood that the method may be varied to achieve similar results within the scope of the invention.

EXAMPLES 1-8

The invention method was first carried out on seven producing wells in a California steam flood project. The suggested apparatus previously described for carrying out the preferred method was mounted on a trailer and employed to obtain the data shown in Table I. The wells of Examples 1, 2 and 3 (Wells 348, 125 and 124, respectively) were side wells in the pattern and wells of Examples 4, 5, 6 and 7 (Wells 444, 363, 368 and 441, respectively) were infill wells. See FIG. 3, a plan view of a California steam flood field, for the pattern location of these wells. The apparatus for practicing the method gave the Table I values listed in rows 1,2,3,5,6 and 8. The information in Table I, rows 4,7,9 and 10 was calculated thereafter. Values shown in row 11 were obtained by use of flow meters and tank gauging.

EXAMPLE 1

The ratio of light hydrocarbon condensate to steam for Well 348 was quite low and the total effluent heat produced was high. However, a check of actual tubing oil production indicated that 86 barrels per day were being produced from Well 1. This was production significantly over the minimum economic production for that well. The laboratory developed correlation between steam and estimated oil contacted by steam to give light hydrocarbon condensate indicated that approximately 63 barrels of oil per day were being contacted by the steam to give the measured casing effluent. Both estimated oil contacted by steam and tubing oil production are generally in agreement. This well appeared to be a normal producer and was left to produce "as is".

EXAMPLE 2

The ratio of light hydrocarbon condensate to steam was below 0.08, requiring that the tubing oil production be checked for Well 125. Tubing oil production was very low, a mere 6 barrels of oil per day, significantly below the minimum economic production for Well 2. However, the estimated oil contacted by the steam was approximately 88 barrels of oil per day to give the produced effluents. This suggested that the oil was being moved through the reservoir in the vicinity of the producing well, but was not being captured by the well. These results indicated that a workover should be done to relieve mechanical damage to the well. A workover was performed by placing a non-perforated liner in the top portion of the formation and perforating the bottom one-third of the formation. Regravel packing was done and the end result was a successful workover with production substantially increased and produced heat decreased.

EXAMPLE 3

Well 124 was also a side well with a substantially high ratio of light hydrocarbon condensate to steam of about 0.14. A light hydrocarbon condensate to steam ratio of this magnitude dispenses with the need to go through the time consuming step of physically measuring tubing oil production for that particular well. However, tubing oil production was measured and came out at 174 barrels of oil per day. The estimated oil contacted by the steam was much greater, about 273 barrels of oil per day.

Since the estimated oil contacted by the steam was sixty percent greater than the actual tubing production, the well appeared to be damaged or incapable of capturing the oil moving past it. A serious steam override was indicated by this data. It also seems logical that a workover, deepening the producing interval, should improve production. However, because the well was producing substantially over the minimum economic oil production level, it was decided to periodically monitor the well with the invention method and permit the well production to decrease below the minimum economic oil production prior to performing a workover.

EXAMPLE 4

The low hydrocarbon condensate to steam ratio of 0.0077 was an immediate indication that Well 444 was a poor producing infill well. The extremely high effluent heat output of the well was a strong factor in favor of shutting in the well. Tubing oil production was measured and found to be about 20 barrels of oil per day. Because approximately 31 estimated barrels of oil per day were contacted by the steam, and production was only 20 barrels per day, it was concluded that the well was producing from a partially depleted zone primarily by stripping. It was further discovered that the well was already completed in the bottom $\frac{1}{3}$ of the formation, making it unlikely that a workover would improve production.

The high heat output of the casing effluent, 2088 MBtu/hr, is equivalent to the heat contained in about 8 barrels of oil per day. Thus, the 20 barrels of oil per day of actual tubing production should be reduced by at least about 8 barrels of oil per day, leaving a figure below minimum economic production for that well. Thus it was recommended that the well be converted to an injector well or shut-in.

EXAMPLE 5

The key ratio of light hydrocarbon condensate to steam for Well 363 was a good figure of 0.084. The estimated oil contacted by steam was almost 4 times that of the actual tubing oil production of 47.5 barrels of oil per day. Additionally, the hydrocarbon condensate and noncondensable effluents were the highest of any well monitored. This indicated that the steam was still contacting considerable new oil. The API gravity of the light hydrocarbon condensate was 35.8° API from formation oil that was 12° API, confirming that the steam was contacting new oil. But the low amount of tubing oil production compared to the estimated oil contacted by the steam suggested mechanical problems with this infill well. It was decided to periodically monitor the well and delay the workover until tubing oil production fell further.

EXAMPLE 6

Infill Well 368 had a light hydrocarbon condensate to steam ratio of 0.016, which suggested possible problems. Tubing oil production was measured and then compared with the estimated oil contacted by steam (28 barrels of oil per day estimated to 35 barrels of oil produced per day). This information indicated that the well was producing from a partially depleted zone and probably did not have mechanical problems. It was thought that most of the production was due to gravity drainage and stripping from the partially depleted zone. Periodic monitoring of the well was begun to give an indication of when tubing oil production would drop below the minimum economic production level for that well. A recommendation was made to convert the infill well to an injector or shut-in the well at that time.

EXAMPLE 7

The low light hydrocarbon condensate to steam ratio for Well 441 immediately indicated a problem. Estimated oil contacted by steam was a low 20 barrels of oil per day and tubing production was measured at 0 barrels of oil per day. Fortunately, the well was exhausting a low amount of annulus effluent from the formation.

This low heat and annulus effluent production, coupled with 0 tubing oil production indicated that the well was producing from a depleted zone. It also indicated that a workover would be likely to increase production. However, the amount of production increase to be expected from a workover (as indicated by the estimated oil contacted by steam) was not considered to be sufficient to justify a workover. It was recommended to convert this infill well to an injector well at the proper time.

EXAMPLE 8

The invention method was practiced on an additional steam flood producing well in the same California field as Examples 1–7. The method gave a high casing flow of 100 barrels of water per day in the form of steam and a heat loss of about two million Btu/hr. This was a significant heat loss and would only serve to damage the steam cap in that area for future projects.

The tubing oil production was only 23 barrels of oil per day. Eight barrels of oil per day, the equivalent of two million Btu/hr., was subtracted from the tubing production to give a net production of 15 barrels of oil per day. It was recommended to shut-in this uneconomic well.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

TABLE I

SUMMARY OF TEST RESULTS AND ESTIMATED OIL CONTACTED BY STEAM

Figure 3:
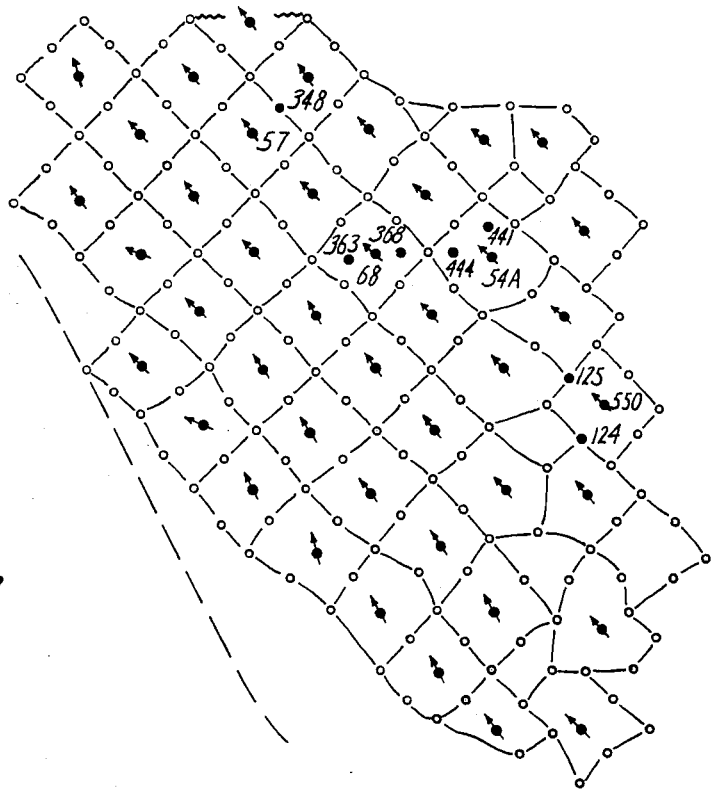
FIG. 3 is a plan view of a steam flood field, illustrating a few of the wells discussed in the Examples.

| | EXAMPLES | | | | | | |
|---|---|---|---|---|---|---|---|
| | 1 | 2 | 3 | 4 | 5 | 6 | 7 |
| FIG. 3 Well No. | 348 | 125 | 124 | 444 | 363 | 368 | 441 |
| 1. Noncondensable Gases, MSCF/D | 14.83 | 15.21 | 11.96 | 0.17 | 39.17 | 1.44 | 0.43 |
| 2. Light Hydrocarbon Condensate, B/D | 3.40 | 3.29 | 5.22 | 0.93 | 5.91 | 1.26 | 1.10 |
| 3. Steam (as condensed water), B/D | 89.99 | 49.70 | 37.87 | 120.57 | 70.23 | 79.41 | 32.12 |
| 4. Light HC Condensate/Steam | 0.0378 | 0.0662 | 0.1378 | 0.077 | 0.0842 | 0.0159 | 0.0342 |
| 5. Annulus Temperature, °F. | 294.00 | 306.00 | 308.00 | 310.00 | 280.00 | 284.00 | 305.00 |
| 6. Steam Quality, % | 98.8 | 98.70 | 97.80 | 99.00 | 99.00 | 98.90 | 97.30 |
| 7. Total Effluent Heat MBtu/hr | 1583.48 | 892.95 | 693.80 | 2088.42 | 1279.18 | 1370.80 | 561.91 |
| 8. Length of Test, hr. | 22.40 | 16.00 | 19.60 | 6.80 | 22.90 | 19.10 | 23.70 |
| 9. Estimated $V_w/V_{oil}$ | 1.43 | 0.56 | 0.14 | 3.88 | 0.38 | 2.84 | 1.62 |
| 10. Estimated Oil Contacted by Steam, B/D | 62.9 | 88.34 | 272.79 | 31.10 | 184.82 | 27.97 | 19.87 |
| 11. Tubing Oil Production, B/D | 86.00 | 6.00 | 174.00 | 20.20 | 47.50 | 35.00 | 0.00 |

What is claimed is:

1. A method of evaluating the annulus effluent of a producing well used in a steam injection process to determine the best disposition for the well, which comprises:

(a) measuring the flow rate of the annulus effluent;

(b) condensing the annulus effluent;

(c) separating the annulus effluent into three phases of light hydrocarbon condensate, water and noncondensable gases;

(d) measuring the quantities of each of the three phases of the annulus effluent;

(e) calculating a ratio of the quantity of light hydrocarbon condensate to the quantity of water in the annulus effluent;

(f) calculating minimum economic oil production from well costs and estimated production revenues;

(g) calculating estimated volume of oil contacted by steam in the formation from previous correlations, said correlations previously drawn between steam and light hydrocarbon condensate produced as vapor after contacting predetermined volumes of oil having the same characteristics as oil from said producing well; and (h) determining the best disposition of the well using the following guidelines:

(1) if said ratio of light hydrocarbon condensate to water is greater than about 0.08 and actual tubing and annulus production is greater than minimum economic oil production, the well should be left to produce "as is";

(2) if said ratio is greater than about 0.08 and actual tubing and annulus production is less than minimum economic oil production, a workover should be performed on the well;

(3) if said ratio is less than about 0.08 and actual tubing and annulus production is greater than the minimum economic oil production, the well should be left to produce "as is";

(4) if said ratio is less than about 0.08 and estimated volume of oil contacted by steam is less than the minimum economic oil production and actual tubing and annulus production is less than the minimum economic oil production, the well's tubing and annulus production should be shut-in; and (5) if said ratio is less than about 0.08 and estimated volume of oil contacted by steam is greater than the minimum economic oil production and actual tubing and annulus production is less than the minimum economic oil production, a workover should be performed on the well.

2. The method of claim 1, wherein a representative sample of the annulus effluent is taken, condensed, separated and measured.

3. A method of evaluating the annulus effluent of a producing well used in a steam injection process to determine the best disposition for the well, which comprises:

(a) measuring the flow rate of the annulus effluent;

(b) taking a representative sample of the annulus effluent;

(c) splitting the sample into vapor and entrained liquid streams;
(d) separating the entrained liquid stream into oil and water phases;
(e) measuring the quantities of the entrained liquid oil and water phases;
(f) condensing the vapor stream;
(g) separating the vapor stream into three phases of light hydrocarbon condensate, water and noncondensable gases;
(h) measuring the quantities of each of the three phases of the vapor stream;
(i) calculating total water in the annulus effluent by adding amount of entrained liquid water to amount of water phase in the vapor stream;
(j) calculating a ratio of the quantity of light hydrocarbon condensate to the quantity of water in the annulus effluent;
(k) calculating minimum economic oil production from well costs and estimated production revenues;
(l) calculating estimated volume of oil contacted by steam in the formation from previous correlations, said correlations previously drawn between steam and light hydrocarbon condensate produced as vapor after contacting predetermined volumes of oil having the same characteristics as oil from said producing well; and
(m) determining the best disposition of the well using the following guidelines:
(1) if said ratio of light hydrocarbon condensate to water is greater than about 0.08 and actual tubing and annulus production is greater than minimum economic oil production, the well should be left to produce "as is";
(2) if said ratio is greater than about 0.08 and actual tubing and annulus production is less than minimum economic oil production, a workover should be performed on the well;
(3) if said ratio is less than about 0.08 and actual tubing and annulus production is greater than the minimum economic oil production, the well should be left to produce "as is";
(4) if said ratio is less than about 0.08 and estimated volume of oil contacted by steam is less than the minimum economic oil production and actual tubing and annulus production is less than the minimum economic oil production, the well's tubing and annulus production should be shut-in; and
(5) if said ratio is less than about 0.08 and estimated volume of oil contacted by steam is greater than the minimum economic oil production and actual tubing and annulus production is less than the minimum economic oil production, a workover should be performed on the well.

4. The method of claim 3, wherein multiple samples of the annulus effluent are taken, condensed, separated and measured.

5. The method of claim 3, wherein API gravity of the light hydrocarbon condensate is measured.

6. The method of claim 3, wherein API gravity of the entrained oil is measured.

7. The method of claim 3, wherein steam quality of the annulus effluent is calculated from the total water produced in the annulus effluent and the amount of water phase in the vapor stream.

8. The method of claim 3, wherein a demulsifying agent is added to the vapor stream to aid in separating the vapor stream into three phases.

9. The method of claim 3, further including measuring the flow rate of the vapor stream.

10. The method of claim 3, further including the determination of an overall heat flow rate from said producing well by
(a) calculating component flow rates of each phase of entrained liquid oil, entrained liquid water, light hydrocarbon condensate, steam and noncondensable gas from the respective quantities of each component measured and the overall flow rate of the annulus effluent;
(b) multiplying the component flow rate of each component by predetermined heat enthalpies for each respective component at the temperature and pressure of the annulus effluent to yield a heat flow rate for each component;
(c) summing the heat flow rates for each component from the annulus to yield an overall heat flow rate for said producing well.

11. The method of claim 10, wherein minimum economic oil production is increased by the cost of producing sufficient steam to equal the overall heat flow rate for said well.

12. A method of evaluating the annulus effluent of a producing well used in a steam injection process to estimate the volume of oil in the vicinity of the producing well being contacted by steam, which comprises:
(a) measuring the flow rate of the annulus effluent;
(b) condensing the annulus effluent;
(c) separating the annulus effluent into three phases of light hydrocarbon condensate, water and noncondensable gases;
(d) measuring the quantities of light hydrocarbon condensate and water in the separated phases;
(e) calculating a ratio of the quantity of light hydrocarbon condensate to the quantity of water in the annulus effluent; and
(f) calculating the estimated volume of oil contacted by steam in the vicinity of the producing well from previous correlations, said correlations previously drawn between steam and light hydrocarbon condensate produced as vapor after contacting predetermined volumes of oil having the same characteristics as oil from said producing well.

13. The method of claim 12, wherein a representative sample of the annulus effluent is taken, condensed, separated and measured.

14. The method of claim 12, wherein a demulsifying agent is added to the annulus effluent to aid in separating the effluent into the three phases.

* * * * *